United States Patent [19]

Steen

[11] Patent Number: 4,703,931

[45] Date of Patent: Nov. 3, 1987

[54] APPARATUS FOR RETURNING OR REBOUNDING A BALL

[76] Inventor: Evert J. Steen, 1921 Bayswater Road, Vancouver, British Columbia, Canada, V6K 4A6

[21] Appl. No.: 796,182

[22] Filed: Nov. 7, 1985

[51] Int. Cl.[4] ..... A63B 69/00

[52] U.S. Cl. ..... 273/26 A; 273/182 R; 273/410; 273/411; 273/29 A

[58] Field of Search ..... 273/29 A, 26 R, 26 A, 273/55 B, 181, 181 J, 181 K, 182 R, 410, 411, 127 R, 127 B, 127 C

[56] References Cited

U.S. PATENT DOCUMENTS

| | | | |
|---|---|---|---|
| 1,540,670 | 6/1925 | Vidmer | 273/181 F |
| 2,397,921 | 4/1946 | Cole | 273/102.4 |
| 2,929,334 | 12/1975 | Magazzu | 273/26 |
| 3,408,071 | 10/1968 | Lundy | 273/26 A |
| 3,502,330 | 3/1970 | Cheftel | 273/26 R |
| 3,711,092 | 1/1973 | Hogue | 273/26 |
| 3,752,476 | 8/1973 | Mahoney | 273/1.5 |
| 3,822,883 | 7/1974 | De Vos | 273/1 R |
| 4,082,271 | 4/1978 | Martin | 273/26 |
| 4,127,267 | 11/1978 | Bay et al. | 273/26 |
| 4,135,716 | 1/1979 | Ginsberg | 273/29 B C |
| 4,254,952 | 4/1981 | Playter | 273/26 |
| 4,381,110 | 4/1983 | Balaz | 273/181 F |
| 4,417,728 | 11/1983 | Hay et al. | 273/29 |
| 4,497,485 | 2/1985 | Macosko | 273/26 |
| 4,517,953 | 5/1985 | Osaka et al. | 124/17 |

*Primary Examiner*—Richard C. Pinkham
*Assistant Examiner*—T. Brown
*Attorney, Agent, or Firm*—Bruce A. Kaser

[57] ABSTRACT

A rebounding net (16) is supported in a portable frame (19). The net (16) includes a rectangular forward end (18) which provides a ball entry/exit way of a certain area through which a ball can move. The net (16) further includes a rearward end (32) which provides a ball-rebounding surface, and the net's forward end is connected to its rearward end by converging sidewalls (24,26,28,30). The sidewalls (24,26,28,30) have a generally trapezoidal-like shape and the net's rearward end (32) has a generally rectangular shape. The net (16) is supported by the frame in such a manner that tension in the net can be adjusted to influence the net's ball rebounding or returning characteristics.

4 Claims, 8 Drawing Figures

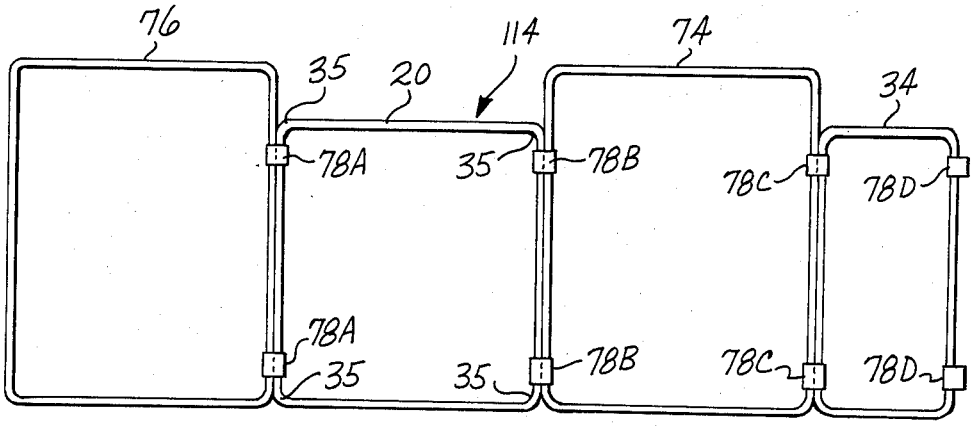
Fig. 3
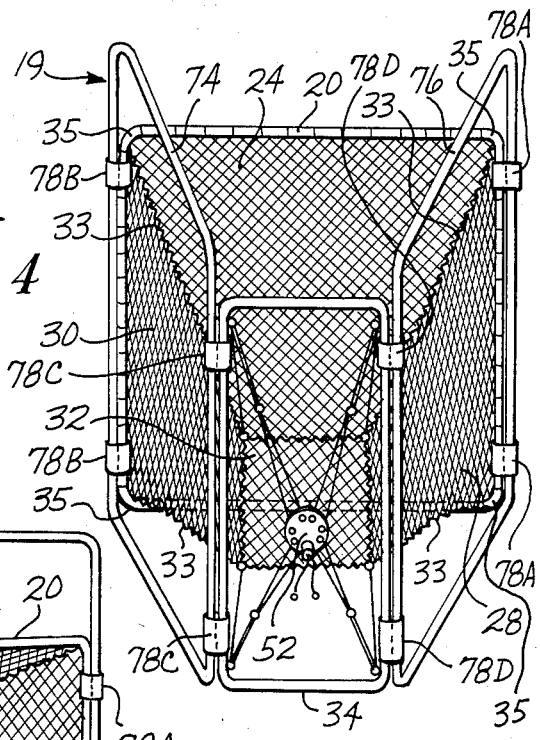
Fig. 4
Fig. 5
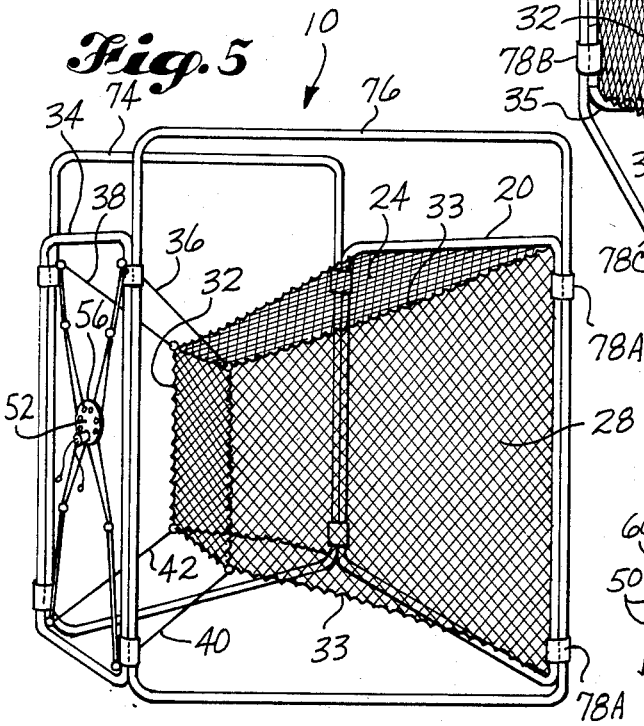
Fig. 6
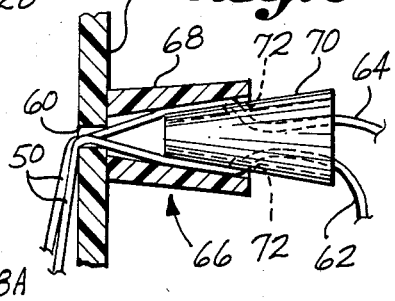

APPARATUS FOR RETURNING OR REBOUNDING A BALL

TECHNICAL FIELD

This invention generally relates to self-practice devices for ball sports. More particularly, the invention relates to a device that returns or rebounds a ball that is thrown, kicked, or hit into the device.

BACKGROUND ART

Many devices are known in the prior art which can rebound or return thrown, kicked or hit balls. The typical purpose of these devices is to provide a means for a person to individually practice a particular ball sport that usually requires more than one participant. For example, U.S. Pat. No. 3,711,092 issued to Hogue on Jan. 16, 1973 illustrates a ball-rebound apparatus which has been widely used for providing baseball pitching practice. The would-be baseball pitcher first throws a baseball against the flat but tensioned nylon net disclosed in this patent. The elasticity of the net then rebounds the ball back to the pitcher thereby eliminating any need of a catcher.

The present invention may be used for the same purpose as Hogue but provides certain advantages over Hogue and other devices of like kind. Such advantages will become apparent upon reading the remaining parts of this application.

DISCLOSURE OF THE INVENTION

The invention includes a portable frame which supports a rebounding net. The rebounding net includes a forward end, connected to the frame, that provides a ball entry/exit way of a certain area. A moving ball can enter the net through the entry/exit way, and can further rebound outwardly therefrom. A rearward end of the net provides a ball-rebounding surface of a given area. The area of this surface is less than the area of the ball entry/exit way, and the net's forward end is connected to its rearward end by converging sidewalls. These sidewalls direct the ball to and from the ball-rebounding surface.

The net may be made of nylon fishing net or any other suitable material having a sufficient amount of elasticity. Elasticity in the net is controlled by a tensioning means which supportably couples the rearward end of the net to the frame. Adjusting the tensioning means likewise adjusts net tension and correspondingly enhances or restrains the net's rebounding ability.

The invention provides a portable frame that is easily foldable for either storing the frame, or for moving it from one location to another. The frame includes a rectangular forward frame member, a rectangular rearward frame member, and a pair of rectangular lateral frame members connecting the forward frame member to the rearward frame member. All of the frame members are of a light-weight tubular construction.

The frame is foldable because its various frame members are connected to each other in a pivotal manner, which permits folding of one member on top of the other into a generally flat configuration. To illustrate, one of the lateral frame members is connected to the forward frame member in a manner so that such lateral frame member can pivot relative to the forward frame member. The other lateral frame member is likewise connected to the forward frame member, and is also connected to the rearward frame member, in a manner so that the other lateral frame member can pivot relative to both the forward and rear frame members.

The frame's front and two lateral members have approximately the same width. The rear frame member is narrower, meaning that when the frame is set up for operation, i.e., the frame members are connected together, the lateral frame members generally converge toward the rearward frame member. This gives the entire frame a tapered configuration.

The forward end of the net is connected to the forward frame member and the perimeter of the forward frame member defines the area of the net's entry/exit way. The previously mentioned converging net sidewalls include a top sidewall, a bottom sidewall, and a pair of lateral sidewalls connecting the bottom sidewall to the top sidewall. Each of these sidewalls has a generally trapezoidal-like shape and the sidewalls converge into the rearward end of the net, the latter having a generally flat and rectangular shape. The tensioning means couples the net's rearward end to the frame in a manner such that the rearward end is supported by the rearward frame member.

The tensioning means includes a plurality of tensioning cords, with at least one cord being connected adjacent each corner of the net's rearward end. It further includes a plurality of eyelets mounted to the rearward frame member, with at least one eyelet being mounted adjacent each corner of that particular member. Each tensioning cord is threaded from its respective corner of the net's rearward end through a corresponding eyelet mounted to a like corner of the rearward frame member. All of the tensioning cords are then tightened, whereby such tightening causes the cords to pull the corners of the net's rearward end both rearwardly and radially outwardly. This pulling places the net in tension.

The tensioning cords are tightened by using a disk member which has a first, second and third pair of eyelets extending through the disks's thickness. The eyelet pairs are spaced a distance from each other and distributed circumferentially adjacent the periphery of the disk member. The disk member further includes a tightening eyelet that also extends through its thickness.

Actual tightening of the tensioning cords is accomplished by a tightening cord which couples the tensioning cords to the various eyelet pairs in the disk member. The tightening cord is threaded through the eyelet pairs and through the tightening eyelet in a manner so that placing the tightening cord in tension causes the plurality of tensioning cords to pull the net in tension. The tightening cord is placed in tension by pulling it through the tightening eyelet. A locking member holds the tightening cord in place after it has been pulled sufficiently so that it is in a desired tension. Pulling or releasing the tightening cord by using the locking member provides a means of variably adjusting net tension.

There are many advantages associated with the invention. The invention provides a ball-rebound device which is durable, inexpensive, lightweight, portable, and easy to assemble for storage. The invention permits the user to practice various ball sports and also can be used to return frisbees and hockey pucks. If desired, it is also possible to remove all tension in the net and use the net merely as a ball-receiving device.

BRIEF DESCRIPTION OF THE DRAWINGS

In the drawings, like reference numerals refer to like parts throughout the various views, and:

FIG. 3 is a side view showing four rectangular tubular frame members or sections which make up the frame shown in FIGS. 1 and 2;

FIG. 4 is a pictorial view looking at the rearward end of the device shown in FIGS. 1 and 2;

FIG. 5 is a pictorial view showing the rearward end and one side of the device shown in FIGS. 1, 2 and 4;

FIG. 6 is an enlarged side view, partially in cross-section, of a tightening cord locking member, and is taken along line 6—6 in FIG. 7;

BEST MODE FOR CARRYING OUT THE INVENTION

Figure 1:
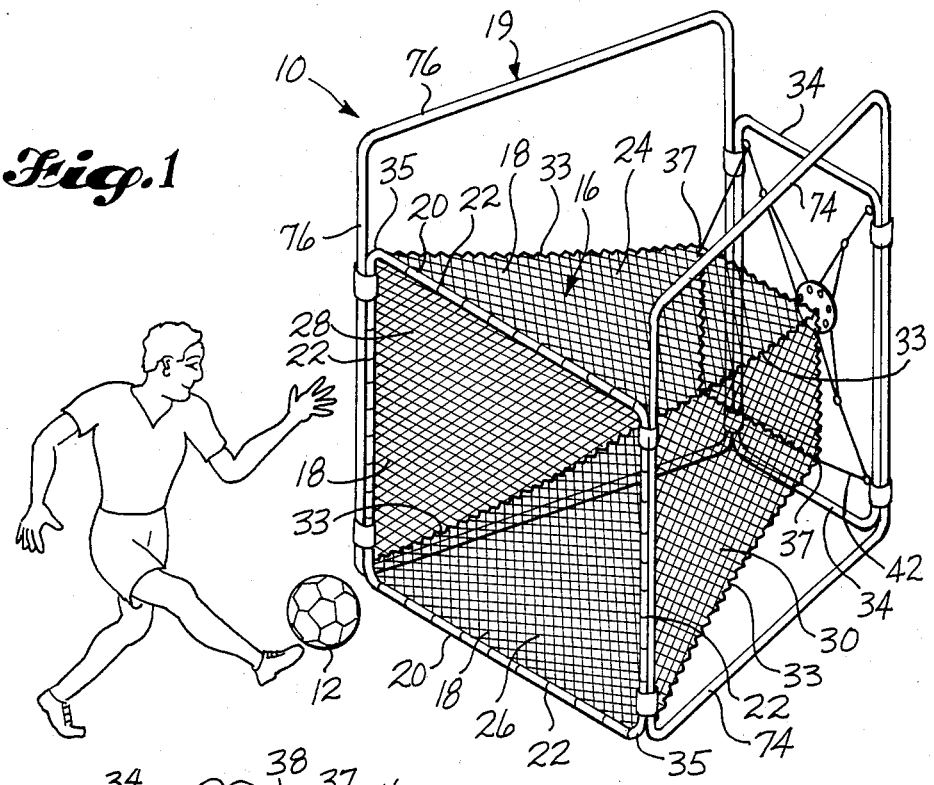
FIG. 1. is a pictorial view showing a ball-rebound device, which includes a frame supporting a ball-rebounding net constructed in accordance with the invention, and in operational position for use in returning a kicked soccer ball.
Figure 2:
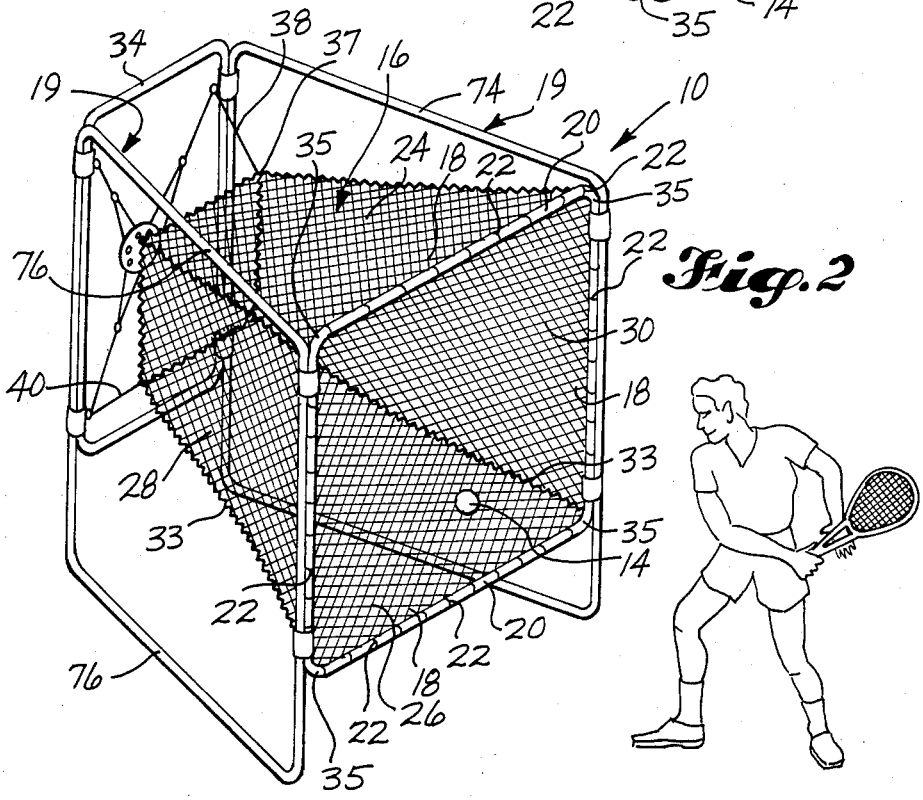
FIG. 2 is a pictorial view much like FIG. 1 but shows the device inverted from its position shown in FIG. 1, and in operational position for returning a tennis ball hit into the device.

Referring now to the drawings, and first to FIG. 1, therein is shown at 10 a ball-rebound device constructed in accordance with a preferred embodiment of the invention. The device 10 is shown in operational use for returning or rebounding a soccer ball 12 kicked into the device. In FIG. 2, the device is shown in an inverted position for returning or rebounding a tennis ball 14. Hereafter, the device 10 will be described only in the context of returning a ball, but it is to be understood that the device 10 may be used for returning other items which have already been mentioned above.

As shown in the various Figs., the device 10 includes a rebounding net indicated generally by 16. The net 16 is supported by a tubular frame 19 and is made of nylon fishing net or any other suitable material having similar elastic properties.

The net 16 is shaped to have a generally trapezoidal-like basket configuration. A forward end portion or end 18 of the net 16 is connected to a forward rectangular frame member 20. The net's forward end 18 is connected to the forward frame member 20 by a plurality of nylon ties 22 or any other suitable means. The net 16 includes four converging sidewalls; a top sidewall 24, a bottom sidewall 26, and a pair of lateral sidewalls 28, 30 which connect the bottom sidewall 26 to the top sidewall 24. The sidewalls 24,26,28,30 each have a generally trapezoidal-like shape and converge into a rectangular rearward end 32 of the net 16.

A length of cord 33 extends along the intersection of each sidewall. Each cord is tied to each corner 35 of the forward frame by one of the nylon ties 22, and is further connected to each corner 37 of the net's rearward end 32. The various sidewalls 24,26,28,30 are sewn to each cord 33.

The frame's forward member 20 defines a net entry/exit way which has an area approximately corresponding to the area defined by the frame member's perimeter. The net's rearward end 32 has an area smaller than the area of the entry/exit way and provides a flat rebounding surface area, whereby the converging sidewalls guide a ball into the net 16 and against this surface.

The rearward end 32 is coupled to a rearward frame member 34 by means of four tensioning cords or cables 36,38,40,42. Tension in the cords 36,38,40,42 pulls the corners 37 of the rearward end 32 both rearwardly and radially outwardly which, in turn, pulls the cords 33 in the net's sidewalls 24,26,28,30. This places the entire net 16 in tension. Tensioning the net, which will be further described later, permits the net 16 to elastically return a ball. As mentioned above, the net's converging sidewalls 24,26,28,30 guide a ball against the net's rearward end 32 where the ball rebounds. As would be apparent to a person skilled in the art, even those balls which are poorly kicked or hit, i.e., balls which initially hit against any one of the sidewalls 24,26,28,30, will be directed against the net's rearward end 32. Therefore, the user of the device 10 need only kick or hit a ball with sufficient accuracy to get the ball through the entry/exit way, and the ball will be automatically returned to the user.

Figure 7:
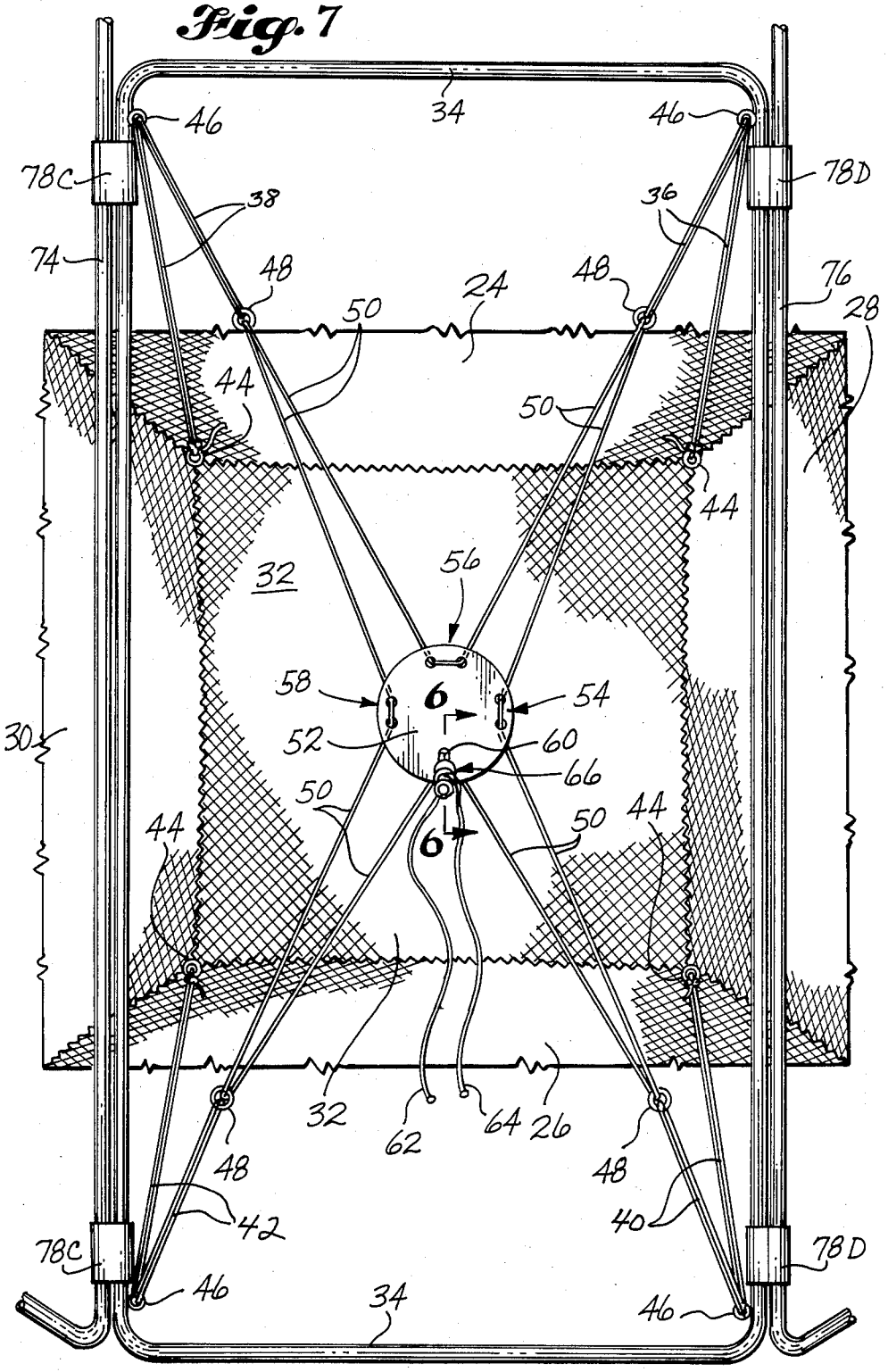
FIG. 7 is an enlarged rearward view of the device shown in FIGS. 1, 2, 4 and 5.

Referring again to the tensioning cords 36,38,40,42, and referring specifically to FIG. 7, each tensioning cord is made of a doubled loop of suitable material such as nylon cord, for example. Each tensioning cord or loop 36,38,40,42 is connected to a grommet 44 sewn to each corner 37 of the net's rearward end 32. Further, each cord 36,38,40,42 is threaded through an eyelet 46 mounted adjacent each corner of the rearward frame member 34, and a coupling eyelet 48 is strung on each tensioning cord for coupling the cords to a tightening cord 50.

Tensioning the tightening cord 50 pulls the coupling eyelets 48 radially inwardly and further pulls the tensioning cords 36,38,40,42. The tightening cord 50 is tensioned or tightened by means of a circular disk member or disk 52. The disk 52 has three pairs of eyelets, indicated generally by arrows 54,56, and 58, respectively. The disk 52 also has a tightening eyelet 60. Each eyelet pair 54,56,58 is spaced from the other and the pairs are distributed circumferentially on the disk 52, about 90 degrees apart, and adjacent the periphery of the disk. All of the eyelets in the disk 52 extend through the disk's thickness.

The tightening cord 50 is threaded through each pair of eyelets 54,56,58 in the manner shown in FIG. 7, and is further threaded rearwardly out through the tightening eyelet 60. Pulling the ends 62,64 of the tightening cord 50 through the tightening eyelet 60 causes equal tension to be transferred to each tensioning cord 36,38,40,42. Correspondingly, such equal tension is transferred to each corner of the net's rearward end 32 and places the net in tension.

The tightening cord 50 is held in place by a suitable locking member 66. Referring now to FIG. 6, the locking member 66 may be a device of standard construction typically used in conjunction with drawstrings on sleeping bags, jacket hoods, and the like. The locking member 66 includes a first and a second hollow conical member 68,70. The end of the second member 70 nestles inside the first member 68. The second member 70 includes bores 72 in its sidewalls through which pass the ends 62,64 of the tightening cord 50. When the second conical member 70 is jammed into the first conical member 68, the cord ends 62,64 are constrained between the walls of the members 68,70, thereby holding the tightening cord 50 in place. It is to be understood that many types of locking members would be suitable other than the one depicted in FIG. 6.

As was indicated above, an advantage to the invention is that the frame 19 and net 16 are portable and foldable for either storing or moving the device 10. The frame 19 includes the previously described forward and rearward frame members 20,34, and further includes a pair of rectangular lateral frame members 74,76 which connect together the forward and rearward frame members. The forward frame member 20 is wider than the rearward frame member 34 but is of generally the same width as the lateral frame members 74,76. Therefore, when all the frame members 20,34,74,76 are connected together in the manner shown in FIGS. 1, 2, 4 and 5, the lateral members converge generally toward the rearward end of the frame 19, thus following the general outline of the net 16. The various frame members may be made of sections of hollow aluminum tubing suitably connected together.

It should be appreciated that the various frame members 20,34,74,76 may be connected together by a variety of suitable methods. However, in preferred form, they are pivotally connected in a manner so that the frame 19 can be folded without disconnecting the frame members from each other. FIG. 3 shows how the frame members may be so connected by nylon tube connectors 78. These tube connectors 78 may be standard "E"-type clamps of a standard construction, which would be familiar to a person skilled in the art. In preferred form, one of the lateral side frame members 76 is pivotally connected to the forward frame member 20 by a nylon tube connector 78A. The other lateral side frame member 74 is pivotally connected to both the forward frame member 20 and the rearward frame member 34 by tube connectors 78B and 78C, respectively. Other tube connectors 78D connect the rearward frame member 34 to the first lateral frame member 76, when the device 10 is operational. These latter connectors could by split connectors and would permit connection and disconnection of the rearward frame member 34 to and from the lateral frame member 76.

Figure 8:
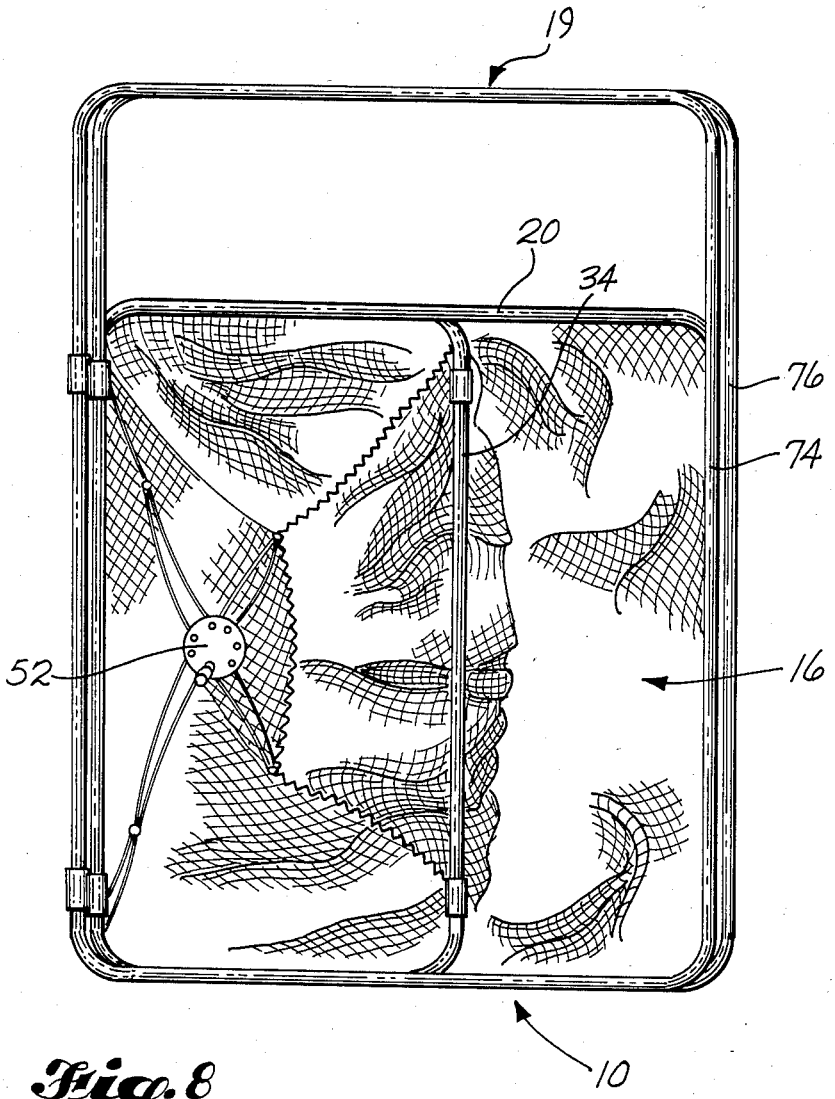
FIG. 8 is a side view of the device and shows the device's frame and net in a folded condition for either storage or transport.

To fold the device 10, the rearward frame member 34 is first disconnected from lateral frame member 76, and then pivoted into the same plane defined by lateral frame member 74. Then, the forward frame member 20 is folded back over the rearward frame member 34 and the remaining lateral frame member 76 is pivoted around and across the front of the forward frame member 20. After this is done, the device 10 is folded into the flat configuration shown in FIG. 8.

It is to be appreciated that the above-described folding sequence could be altered by changing the pivotal connections between the various frame members. The frame members 20,34,74,76 could also be connected together by wire ties, for example, instead of the above-described nylon tube connectors.

It is to be understood that the invention shown and described above could be altered somewhat without departing from the spirit and scope of the invention. A preferred embodiment of the invention has been described herein for illustrative purposes only. The description of the preferred embodiment is not meant to be taken in a limiting sense. Rather, the spirit and scope of the invention is to be limited only by the appended claims which follow as interpreted in accordance with the established doctrines of patent claim interpretation.

What is claimed is:

1. An apparatus for returning or rebounding a ball, comprising:

a portable, free-standing frame, including a forward rectangular tubular frame member having a perimeter defined by a pair of spaced, vertical sections interconnected by a pair of spaced, horizontal sections;

a rebounding net having a forwardly directed open end connected to all of said forward rectangular frame member's sections in a manner so that said frame member's perimeter substantially defines the shape and area of said net's open end, said open end providing an entry/exit way for a ball said net further having a rearward rectangular rebounding surface with a pair of vertical edges generally parallel to said forward frame member's vertical sections, and a pair of horizontal edges generally parallel to said forward frame member's horizontal sections, said net further having four generally trapezoidally shaped sidewalls, one each interconnecting one of said frame member sections and one edge of said rectangular rebounding surface, in a manner so that all of said sidewalls converge symmetrically toward each other from said net opening to said rebounding surface; and tensioning means, supportably coupling each corner of said net rebounding surface to said portable frame, for pulling each corner both rearwardly and outwardly away from each other with substantially the same amount of force being applied to each corner, to place each net sidewall and said rebounding surface in tension, wherein said tensioning means suspends said net from said portable frame so that the only portion of said net directly connected to any portion of said frame is said net's open end, and still further, with said tensioning means being adjustable to vary tension in said net's sidewalls and rebounding surface.

2. The apparatus of claim 1, wherein said tensioning means includes a plurality of tensioning cords, with at least one of said cords being connected substantially adjacent each corner of said net rebounding surface, said portable frame including another rearward rectangular tubular frame member positioned rearwardly of said rebounding surface, and including at least one eyelet mounted adjacent each corner of said rearward frame member, wherein at least one cord extends from each corner of said rebounding surface and is threaded through that eyelet which is nearest said corner, and further including a disk member having a first, second and third pair of eyelets extending through the thickness of said disk member, and having a tightening eyelet also extending through the thickness of said disk member, wherein said pairs of eyelets are circumferentially spaced a distance from each other adjacent the periphery of said disk member, and including a tightening cord, threaded through said eyelet pairs and coupling said tensioning cords to said eyelet pairs, and wherein said tightening cord is further threaded through said tightening eyelet, said tightening cord being threaded through said eyelet pairs and said tightening eyelet in a manner so that pulling said tightening cord through said tightening eyelet causes said tightening cord to tighten and pull against said tensioning cords, such pulling causing an equal tension to arise in each tensioning cord, and further including locking means for maintaining tightness of said tightening cord when it is pulling against said tensioning cords.

3. The apparatus of claim 2, wherein said frame further includes a rectangular rearward frame member, and a pair of rectangular lateral frame members connecting said forward frame member to said rearward frame member, wherein one of said lateral frame members is connected to said forward frame member in a manner so that said lateral frame member is pivotable relative to said forward frame member, and wherein the other of said lateral frame members is connected to both said forward and rearward frame members in a manner so that said other lateral frame member is pivotable relative to both said forward and rearward frame members, such pivotable connections permitting folding of said frame for either storing said apparatus or for moving said apparatus from one location to another.

4. An apparatus for returning or rebounding a ball, comprising:

a portable frame, including a forward rectangular tubular frame member defined by a pair of spaced, vertical sections interconnected by a pair of spaced, horizontal sections; and including a rebounding net having a forwardly directed open end connected to said forward rectangular frame member in a manner so that said frame member's sections define the shape and area of said net's open end, said open end providing an entry/exit way for and ball said net further having a rearward rectangular rebounding surface with a pair of vertical edges generally parallel to said forward frame member's vertical sections, and a pair of horizontal edges generally parallel to said forward frame member's horizontal sections, said net further having four generally trapezoidally shaped sidewalls, one each interconnecting one of said frame member sections with one edge of said rectangular rebounding surface, in a manner so that said sidewalls converge symmetrically from said net opening to said rebounding surface; and including a plurality of tensioning cords, with at least one of said cords being connected substantially adjacent each corner of said net rebounding surface, said portable frame further including another rectangular tubular frame member positioned rearwardly of said net's rectangular rebounding surface, and having horizontal and vertical sections that are substantially parallel to the edges of said net rebounding surface; and including at least one eyelet mounted adjacent each corner of said rearward frame member, wherein at least one cord extends from each corner of said rebounding surface and is threaded through the eyelet which is nearest said corner; and including a disk member having a first, second and third pair of eyelets extending through the thickness of said disk member, and having a tightening eyelet also extending through the thickness of said disk member, wherein said pairs of eyelets are circumferentially spaced a distance from each other adjacent the periphery of said disk member; and including a tightening cord, threaded through said eyelet pairs and coupling said tensioning cords to said eyelet pairs, wherein said tightening cord is further threaded through said tightening eyelet, said tightening cord being threaded through said eyelet pairs and said tightening eyelet in a manner so that pulling said tightening cord through said tightening eyelet causes said tightening cord to tighten and pull against said tensioning cords, such pulling causing an equal tension to arise in each tensioning cord, for pulling each corner both rearwardly and outwardly away from each other so that each net sidewall and said net rebounding surface are placed in tension, and for suspending said net from said portable frame; and further including locking means for maintaining tightness of said tightening cord when it is pulling against said tensioning cords.

* * * * *